United States Patent [19]

Mizuno et al.

[11] 4,403,587

[45] Sep. 13, 1983

[54] FUEL EVAPORATIVE EMISSION CONTROL APPARATUS FOR VEHICLES

[75] Inventors: Junzi Mizuno; Akira Fukami, both of Okazaki; Hiroki Noguchi, Obu; Takeshi Ishii, Okazaki, all of Japan

[73] Assignees: Nippon Soken, Inc., Nishio; Nippondenso Co., Ltd., Kariya, both of Japan

[21] Appl. No.: 359,298

[22] Filed: Mar. 18, 1982

[30] Foreign Application Priority Data

Mar. 23, 1981 [JP] Japan ..... 56-40410

[51] Int. Cl.[3] ..... F02M 37/02

[52] U.S. Cl. ..... 123/519; 55/316; 55/385 B; 55/387; 55/418

[58] Field of Search ..... 123/518–521; 55/316, 385 B, 387, 418

[56] References Cited

U.S. PATENT DOCUMENTS

| | | | |
|---|---|---|---|
| 3,000,467 | 9/1961 | Bowers | 55/201 |
| 3,479,146 | 11/1969 | Hochman et al. | 55/418 X |
| 3,572,013 | 3/1971 | Hansen | 123/519 |
| 3,628,517 | 12/1971 | Soberski | 123/520 |
| 3,683,597 | 8/1972 | Beveridge et al. | 55/387 X |
| 3,730,158 | 5/1973 | St. Amand | 123/519 |
| 3,884,204 | 5/1975 | Krautwurst et al. | 123/519 |
| 4,058,380 | 11/1977 | King | 55/387 |
| 4,173,207 | 11/1979 | Hiramatsu | 123/519 |
| 4,203,401 | 5/1980 | Kingsley et al. | 55/387 X |
| 4,280,466 | 7/1981 | Walters | 123/520 |
| 4,306,894 | 12/1981 | Fukami et al. | 123/519 |
| 4,331,120 | 5/1982 | Hiramatu et al. | 123/519 |
| 4,338,106 | 7/1982 | Mizuno et al. | 123/519 |

FOREIGN PATENT DOCUMENTS

| | | | |
|---|---|---|---|
| 53-77923 | 7/1978 | Japan | 123/519 |

*Primary Examiner*—Ira S. Lazarus
*Assistant Examiner*—Magdalen Moy
*Attorney, Agent, or Firm*—Cushman, Darby & Cushman

[57] ABSTRACT

A fuel evaporative emission control apparatus comprising a vessel having an adsorbent layer therein for adsorbing a vaporized fuel, and a vaporized fuel inlet conduit inserted in the adsorbent layer, wherein the improvement comprises a flow deflector of a hollow conical shape having a diameter gradually increasing upward, the deflector being embedded in the adsorbent layer, the vertical angle (α) of the flow deflector is adjusted to 60° to 120°, the ratio (S1/S2) of the sectional area (S1) of the largest-diameter end portion of the flow deflector to the sectional area (S2) of the adsorbent layer is adjusted to 0.4 to 0.6, the ratio (a/b) of the distance (a) between the largest-diameter end portion of the flow deflector and the top end of the adsorbent layer to the distance (b) between the largest-diameter end portion of the flow deflector and the side end of the adsorbent layer is adjusted to at least 1.5, and the distance (a) is made smaller than the sum (g+b) of said distance (b) and the axial length (g) of the conduit in the adsorbent layer.

18 Claims, 13 Drawing Figures

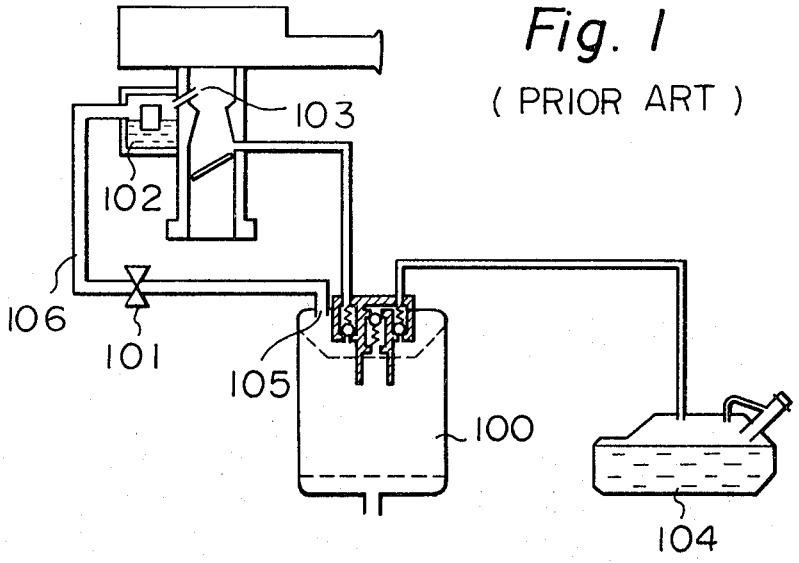
Fig. 1
( PRIOR ART )
Fig. 2
( PRIOR ART )
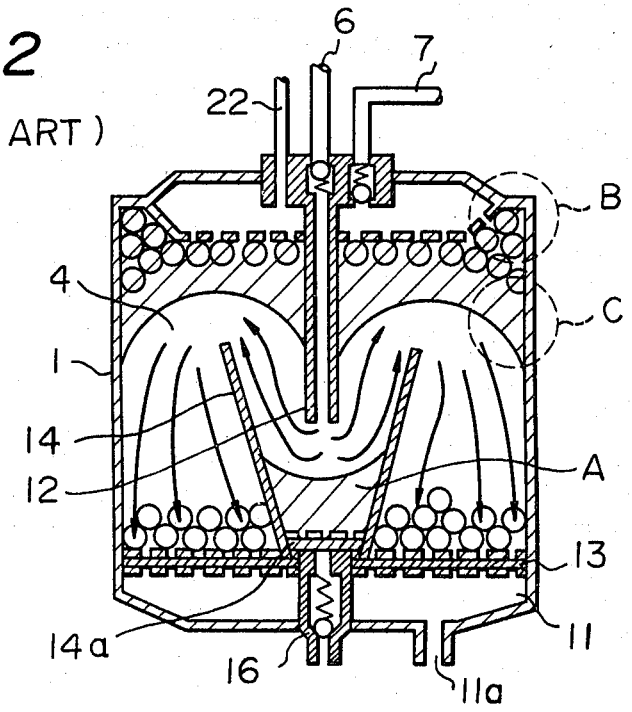

FUEL EVAPORATIVE EMISSION CONTROL APPARATUS FOR VEHICLES

The present invention relates to a fuel evaporative emission control apparatus (a canister apparatus) for a vehicle, especially an automobile.

Furthermore, the present invention relates to a fuel evaporative emission control apparatus of the type provided with a vaporized fuel inlet conduit (ordinarily called "outer vent port") extended from a float chamber of a carburetor.

FIG. 1 is a schematic diagram showing a canister system provided with an outer vent port, which is widely adopted in the art at the present. In FIG. 1, reference numerals 100, 101, 102, 103, 104, and 105 represent an evaporative fuel emission control apparatus, an electromagnetic valve, a float chamber of a carburetor, an air vent, a fuel tank, and an outer vent port, respectively. In order to minimize the air flow resistance for preventing leakage of a vaporized fuel from the air vent 103 of the carburetor, no member causing air flow resistance, such as a check valve, other than the electromagnetic valve 101, is disposed in a passage 106 connected to the outer vent port 105.

As known apparatus of this type, there can be mentioned the apparatus disclosed in Japanese Patent Application Laid-Open No. 53-77923 published July 10, 1978. In this apparatus, as shown in FIG. 2, an adsorbent composed of granular active carbon is filled in the interior of a vessel 1, and a flow deflector 14 of a conical frustrum shape is embedded in a layer 4 of the adsorbent. The bottom 14*a* of the deflector 14 is brought into contact with a filter 13 disposed in the bottom portion of the vessel and is arranged to confront the end portion of a vaporized fuel inlet conduit 12.

Adsorption of the vaporized fuel in the adsorbent layer 4 starts at the end of the vaporized fuel inlet conduit 12 and gradually spreads in the adsorbent layer 4. This spreading of the vaporized fuel is governed by "flow" and "diffusion" of the vaporized fuel. As the result of researches made by us, it has been found that the "flow" is predominant and the "diffusion" is negligible. When it is taken into account that the "flow" is predominant in actual practice, in the apparatus shown in FIG. 2, the vaporized fuel flows along a path of a smallest resistance as indicated by arrows in FIG. 2. Accordingly, in FIG. 2, there are hatched regions A, B, and C in which the adsorbent layer 4 is not utilized.

In the conventional apparatus, a check valve 16 is disposed in the bottom portion of the deflector 14 of a conical frustrum shape to introduce air for desorbing (purging) the vaporized fuel into the adsorbing layer 4, and a purge chamber 11 is arranged in the bottom portion of the vessel 1.

The check valve 16 opened utilizing the subatmospheric pressure i.e. vacuum produced in an intake tube of an engine, has a structure independent from an air opening 11*a* of the purge chamber 11. Accordingly, the relation between the subatmospheric pressure for opening the check valve 16 and the flow resistance in the purge chamber 11 and air opening 11*a* becomes a problem. More specially, if the flow resistance is larger than the subatmospheric pressure for opening the check valve 16, the check valve 16 is opened. The fact that the flow resistance is larger means that the flow resistance in the canister apparatus is larger, and in this case, the quantity of the purging air is decreased, resulting in reduction of the purging capacity. In the case where an outer vent port 22 is attached, because of the flow resistance by this outer vent port, the vaporized fuel from the carburetor float chamber 102 (see FIG. 1) is hardly allowed to flow into the canister apparatus.

Under such background, it is a primary object of the present invention to effectively utilize the adsorbent layer.

A secondary object of the present invention is to open the check valve assuredly without increase of the flow resistance in the purge chamber and air hole.

The present invention will now be described in detail with reference to embodiments illustrated in the accompanying drawings.

BRIEF DESCRIPTION OF THE DRAWINGS

FIG. 1 is a schematic diagram illustrating the canister system provided with an outer vent port, which is actually used at the present.

FIG. 2 is a sectional view illustrating in detail the structure of the known canister apparatus.

DETAILED DESCRIPTION OF THE INVENTION

Figure 3:
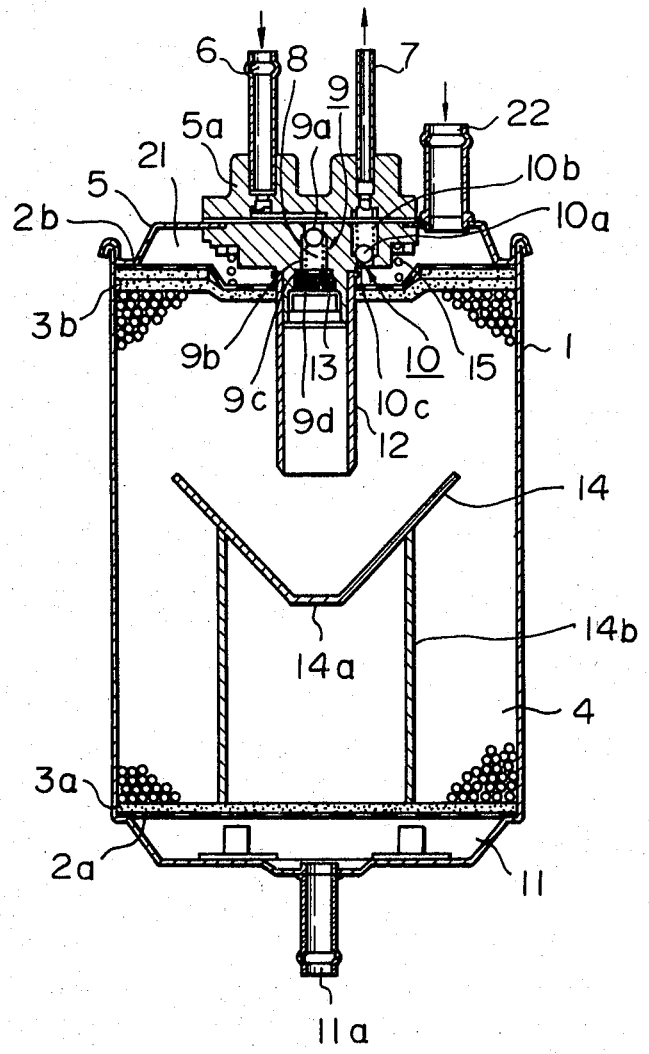
FIG. 3 is a sectional view similar to FIG. 2, which illustrates one embodiment of the first aspect of the present invention.

Referring to FIG. 3 illustrating one embodiment of the present invention, a punching metal 2*a* having many perforations is secured in the form of a shelf in the lower portion of a metal vessel 1 having a circular cross-sectional shape, a glass wool filter 3*a* is arranged on the punching metal 2*a*, and an adsorbent 4 composed of granular active carbon is filled on the filter 3*a*. A lid 5 is secured to an upper opening of the vessel 1 in such a manner that the lid 5 presses a punching metal 2*b* downward. A thick body portion 5*a* is mounted on the lid 5 through a spring 15, and a second vaporized fuel inlet conduit 6 and an air-fuel mixture discharge conduit 7 are connected to the body portion 5*a*. An outer vent port 22 which is communicated with a carburetor float chamber 102 (see FIG. 1) through a vaporized fuel passage 106 (see FIG. 1) is connected to a space 21 formed between the lid 5 and the punching metal 2*b*. As in the apparatus shown in FIG. 1, the second vaporized fuel inlet conduit 6 is communicated with a fuel tank 104 through another vaporized fuel passage while the air-fuel mixture discharge conduit 7 is communicated with an intake passage of the carburetor through an air-fuel mixture flow passage, though these arrangements are not specifically illustrated in FIG. 3.

The basic portion 5*a* comprises a check valve unit 9 for controlling circulation of the fuel vapor from the passage 8 and vaporized fuel inlet conduit 6 and a check valve unit 10 for controlling circulation of the air-fuel mixture to the air-fuel mixture discharge conduit 7 from the interior of the vessel 1. The check valve unit 9 comprises a check ball 9*a* and a spring 9*b* for pressing the ball 9*a* to the opening of the passage 8. When the pressure of the vaporized fuel in the fuel tank reaches a predetermined level, the check valve unit 9*a* allows the fuel vapor to flow into the vessel 1 from an inlet opening 9*d* of a supporting plate 9*c* while intercepting the flow of the fuel in the reverse direction. The check valve unit 10 comprises a check ball 10*a* and a spring 10*b* for pressing the ball 10*a* to the air-fuel discharge opening. When the subatmospheric pressure of the engine reaches a predetermined level, the check valve unit 10 allows the air-fuel mixture to flow to the air-fuel mixture discharge conduit 7 while intercepting the flow of the air-fuel mixture in the reverse direction. A purge chamber 11 is formed in the bottom portion of the vessel 1 and this purge chamber 11 is communicated with the open air through an air hole 11*a*.

One end of a first vaporized fuel inlet conduit 12 is secured to the lower face of the basic portion 5*a* at the position of communication with the fuel vapor inlet opening 9*d*. The diameter of the inlet conduit 12 is larger than the diameter of the opening 9*d*, and the inlet conduit is inserted into the active carbon layer 4 through the centers of the punching metal 2*b* and glass wool 3*b*. Also, in this inlet conduit 12, active carbon is filled at a level substantially equal to the level of the active carbon layer 4, and a glass wool 13 is placed on this active carbon. An electromagnetic valve (see FIG. 1) is disposed in the midway of a fuel vapor conduit connecting the outer vent port 22 to the carburetor float chamber to perform closing and opening operations according to "on" and "off" operations of an ignition switch, though this feature is not specifically illustrated in FIG. 3. Namely, only when the ignition switch is turned off is the carburetor float chamber communicated with the fuel evaporative emission control apparatus.

A flow deflector 14 of a conical frustrum shape having a diameter gradually increasing upward is embedded in the active carbon layer 4 below the inlet conduit 12. The bottom 14*a* of the deflector 14 confronts the lower end of the inlet conduit 12, and the deflector 14 is supported on the glass wool 3*a* in the vessel 1 by four rod-like legs 14*b* attached to the conical face.

If the pressure of the fuel vapor reaches a predetermined level while the engine is stopped, the check valve unit 9 is opened and the fuel vapor formed in the fuel tank is introduced into the active carbon layer 4 through the vaporized fuel inlet conduit 12 and adsorbed therein. The fuel vapor formed in the carburetor float chamber is spread in the space 21 through the outer vent port 22, introduced into the active carbon layer 4 through the perforated punching plate 2*b*, and adsorbed therein. When the subatmospheric pressure of sucked air of the carburetor reaches a predetermined level while the engine is operated, the check valve 10 is opened, whereby air is sucked into the vessel 1 from the air hole 11*a* through the purge chamber 11. The adsorbed fuel vapor is desorbed for active carbon by the sucked air, and the air-fuel mixture is supplied to the carburetor from the air-fuel mixture discharge opening 10*c* through the conduit 7. Incidentally, even if a large quantity of the fuel vapor is produced while the engine is stopped and it flows into the vessel 1 while opening the check valve unit 9, since the check valve unit 10 closes the air-fuel mixture discharge opening 10*c*, the fuel vapor is prevented from being discharged from this opening 10*c*.

In order to minimize the flow resistance for leakage of the vaporized fuel from the air vent of the carburetor, no resistance-causing member such as a check valve, other than the electromagnetic valve, is disposed in the passage communicating the carburetor float chamber with the outer vent port 22.

Figure 4:
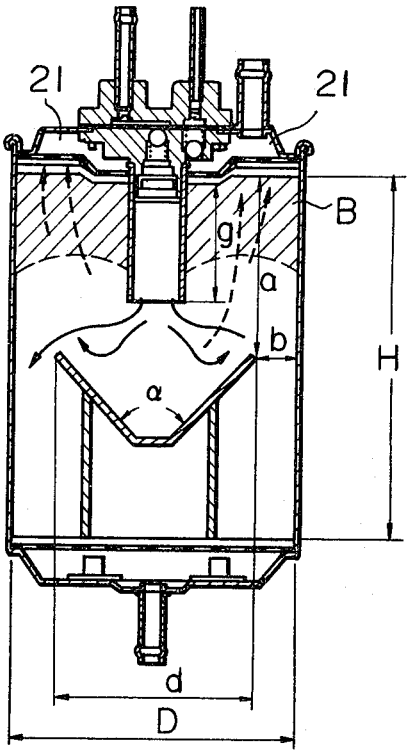
FIG. 4 is a diagram illustrating limitations of the dimensional relations in the apparatus shown in FIG. 3.

The flow deflector 14 is disposed to forcibly change the flow of the fuel vapor upward as shown in FIG. 4. Accordingly, if the distance a between the top end of the flow deflector and the top ene of the adsorbent layer (see FIG. 4) is short, there is a possibility of occurrence of various undesirable phenomena, for example, blow-by to the space 21, as indicated by a broken line in FIG. 4, reverse flow to the carburetor float chamber through the outer vent port 22, and leakage of the fuel vapor from the air vent of the carburetor, which is due to prevention of the fuel vapor from flowing from the carburetor float chamber. These disadvantages will be eliminated if the distance a is increased to some extent. However, if the distance a is excessively increased, the inherent capacity of the apparatus is reduced.

Figure 5:
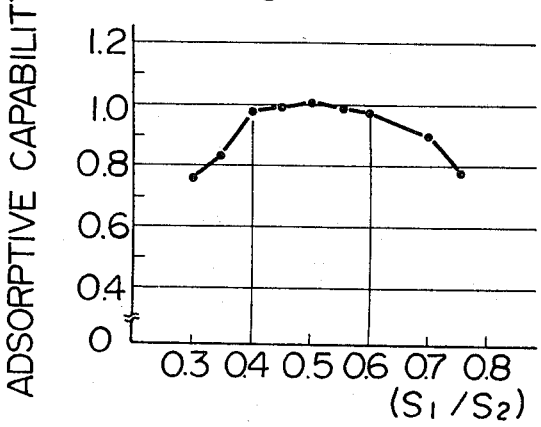
FIGS. 5 through 7 are diagrams showing the relations of the sizes and dimensions of the deflector to the adsorptive capability in the present invention.
Figure 6:
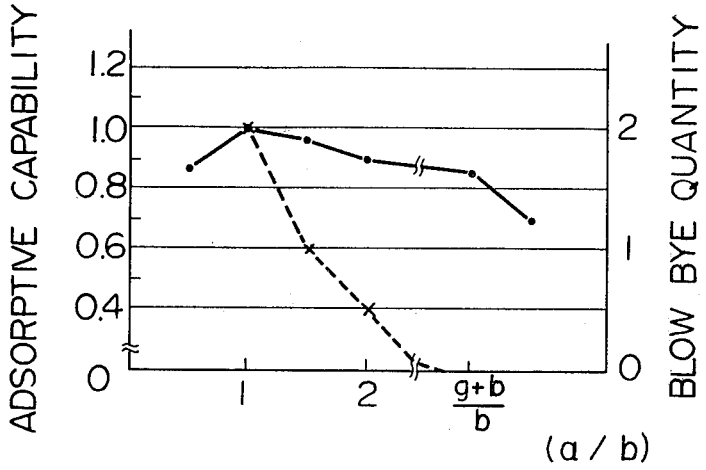
Figure 7:
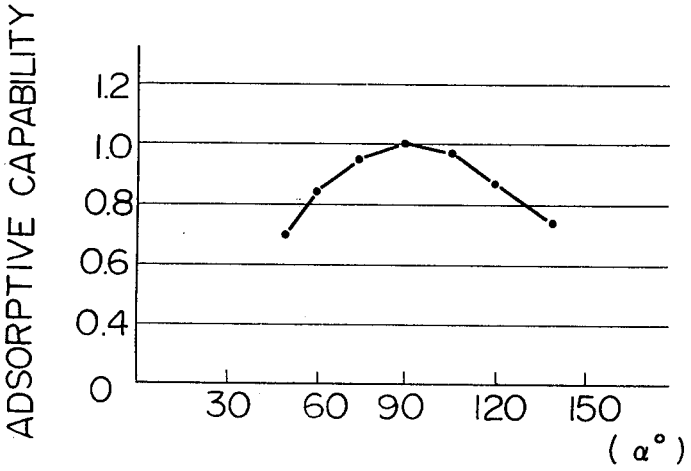

We made experiments on the dimensions of the deflector 14 and the adsorptive capability (the ratio of the volume of the active carbon layer 4 which actually performs the adsorbing action to the entire volume of the active carbon layer 4) in the apparatus having the structure according to the above-mentioned embodiment. The results of these experiments are shown in FIGS. 5 through 7 (see FIG. 4 in connection with the dimensions and sizes). FIG. 5 shows the data of the relation between the cross-sectional area S1 of the largest-diameter portion d of the deflector 14 and the cross-sectional area S2 of the active carbon layer 4 (region D). From the data shown in FIG. 5, it is seen that a substantially equal adsorptive capability can be obtained when the S1/S2 ratio is within the range of from 0.4 to 0.6. If the ratio S1/S2 is larger than 0.6, the flow resistance is increased on the side of the end portion of the deflector 14 and flowing of the fuel vapor is hindered. If the S1/S2 ratio is smaller than 0.4, the sectional area of the passage of the portion b is increased and the fuel vapor is hardly allowed to flow to the vicinity of the side wall of the vessel close to the end portion of the deflector.

Accordingly, it has been confirmed that it is preferred that the S1/S2 ratio be substantially within the range of from 0.4 to 0.6.

FIG. 6 illustrates the relation between the distance a between the top end of the deflector 14 and the top end of the adsorbent layer 4 and the distance b between the top end of the deflector 14 and the side end of the adsorbent layer 4. The adsorptive capability observed when the S1/S2 ratio is 0.5 is indicated by a solid line, and the quantity of blow-by to the outer vent port 22 is indicated by a broken line. From FIG. 6, it is seen that supposing that the allowable value of this blow-by quantity is 1, the a/b ratio should be at least 1.5. As the value of the a/b ratio is increased, the adsorptive capability is gradually reduced and is then abruptly reduced when the a/b ratio exceeds a certain point. It has been confirmed that this point is one at which the distance a is substantially equal to the sum of the above-mentioned distance b and the length g of the vaporized fuel inlet conduit 12 located in the adsorbent layer. It is believed that, as shown in FIG. 4, if the a/b ratio is below this point, the influence of the flow deflector on a part of the flow of the fuel vapor is substantially eliminated. Also this limitation of the a/b ratio is valuable for removal of the non-utilized region C.

As pointed out hereinbefore, as the a/b ratio is increased, the adsorptive capability is reduced, and the region B shown in FIG. 4, in which the adsorbent layer is not sufficiently utilized, is inevitably present. However, this region can be converted to a region of sufficient adsorption by estimating the quantity of the fuel vapor introduced from the outer vent port and selecting an appropriate value for the a/b ratio in the range from 1.5 to (g+b)/b.

Figure 8:
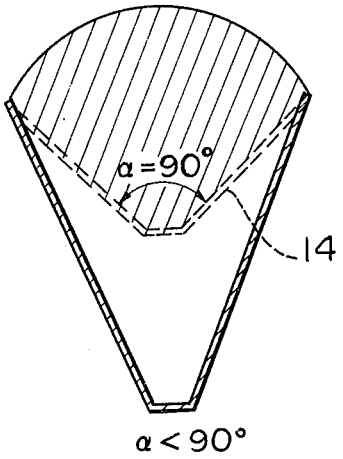
FIGS. 8 and 9 are schematic views showing large and small vertical angles in the flow deflector according to the present invention.
Figure 9:
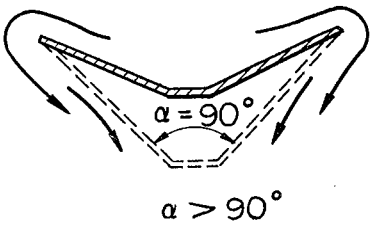

FIG. 7 is a graph illustrating the influence of the vertical angle $\alpha$ of the flow deflector on the adsorptive capability, which is observed when the S1/S2 ratio is 0.5. An optimum value is obtained when the vertical angle $\alpha$ is about 90°. As shown in FIGS. 8 and 9, as the vertical angle $\alpha$ is decreased from 90°, the region A shown in FIG. 2 (hatched region in FIG. 8) where desorption is hardly caused becomes larger, and the adsorptive capability is reduced in the apparatus of the present invention where adsorption and desorption are repeated. As the vertical angle $\alpha$ is increased beyond 90° (see FIG. 9), the fuel vapor is hardly allowed to flow around the outer wall of the flow deflector, resulting in reduction of the adsorptive capability. From the graph of FIG. 7, it is seen that it is preferred that the vertical angle $\alpha$ be in the range of from 60° to 120°.

The foregoing embodiment of the present invention is advantageous over the conventional apparatus shown in FIGS. 1 and 2 in various points. For example, since the flow deflector is not brought into direct contact with the punching metal 2*a* supporting the adsorbent or the filter 3*a*, even if the shape of the vessel is expanded in the longitudinal direction, the adsorbent can be filled directly below the flow deflector. Accordingly, the adsorbed fuel vapor can easily be desorbed from the adsorbent layer in this region, and, consequently, the adsorptive capability of the apparatus of the present embodiment can be enhanced in proportion to the increase of the amount of the filled adsorbent. Furthermore, since the flow deflector of the present invention is embedded in the adsorbent layer independently from the vessel, the existing vessel need not be changed in the shape or structure at all.

When a small number of small holes are formed through the wall of the vaporized fuel inlet conduit 12, the fuel vapor is allowed to flow even to the portion close to the vaporized fuel inlet conduit 12, and the adsorbent layer of this region can also be utilized effectively.

The second aspect of the present invention will now be described with reference to FIG. 10. In an embodiment illustrated in FIG. 10, a check valve unit 16 is mounted on the back face of a bottom 14*a* of deflector 14 integrally therewith. The check valve unit 16 comprises a check ball 17 and a spring 18, which are contained in an air hole 16*b* of a valve body 16*a*, and the check ball 17 is pressed by the spring 18 through a spring-pressing plate 19 (for example, a punching metal or metal net). A filter 20 composed of glass wool is placed on the pressing plate 19, and the air hole 16*b* of the check valve unit 16 is communicated with a purge chamber 11. Other members and arrangements are the same as in the embodiment shown in FIG. 3.

In the foregoing embodiment, when a pressure difference is produced in the active carbon layer 4 because of the subatmospheric pressure of the engine acting on the discharge conduit 7, the check valve unit 16 is opened and air is allowed to pass through the portion of the check valve unit 16. Accordingly, the fuel-desorbing air is introduced also on the inner side of the deflector 14, and, therefore, reduction of the adsorptive capability at the repeated adsorption can be avoided and there is no influence of blow-bye to the outer vent port.

Also in this embodiment, as in the above-mentioned embodiment of the first aspect of the present invention, the values of S1/S2, a/b and $\alpha$ are limited to 0.4 to 0.6, 1.5 to (g+b)/b, and 60° to 120°, respectively.

Figure 10:
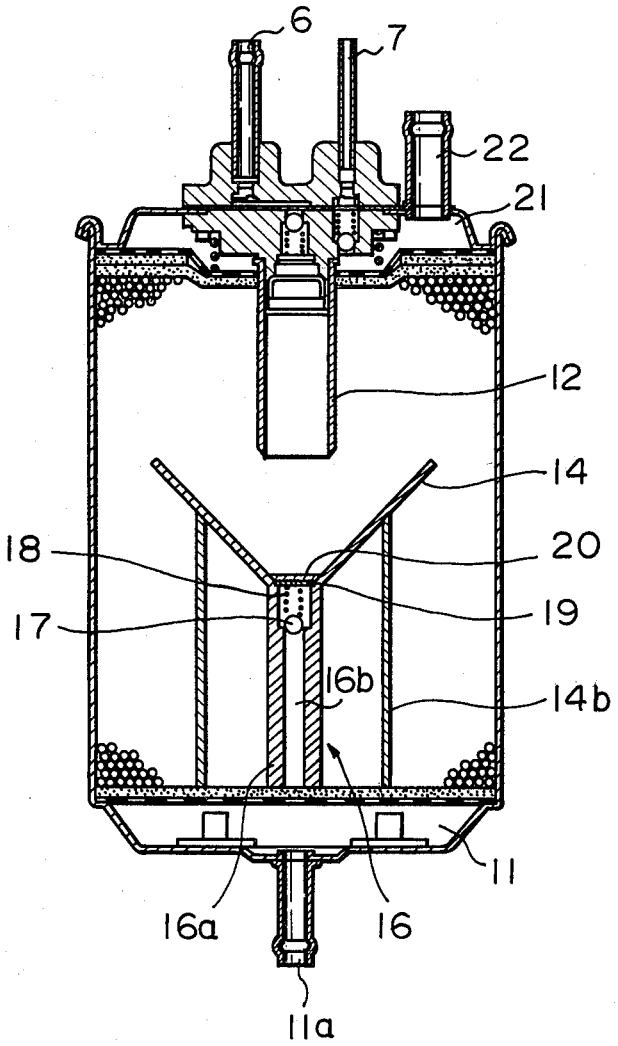
FIG. 10 is a sectional view similar to FIG. 3, which illustrates one embodiment of the second aspect of the present invention.
Figure 11:
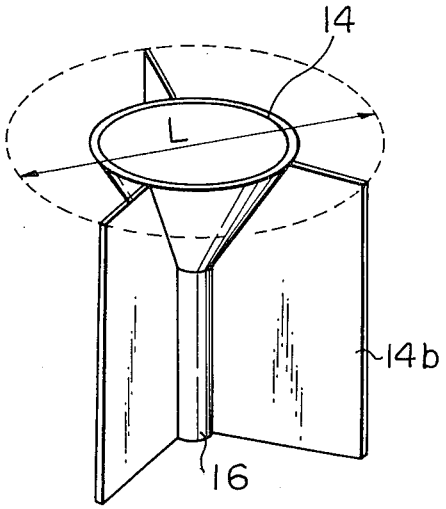
FIG. 11 is a perspective view showing a modification of the flow deflector shown in FIG. 10.

FIG. 11 illustrates another embodiment different from the embodiment shown in FIG. 10. In the embodiment shown in FIG. 11, the legs 14*b* of the deflector 14 are formed to have a plate-like shape, and the confronting distance L of the legs 14*b* (the diameter of a circle drawn by the end edges of the legs 14*b*) is made in agreement with the inner diameter D of the vessel 1. If this deflector 14 is employed, positioning of the deflector 14 in the vessel 1 can be facilitated, and the center of the deflector is in agreement with the center of the vessel 1. Accordingly, deviation of the flow of the fuel vapor or desorbing air can be prevented. Of course, the above-mentioned plate-like legs can also be applied to embodiments of the first aspect of the present invention.

Figure 12:
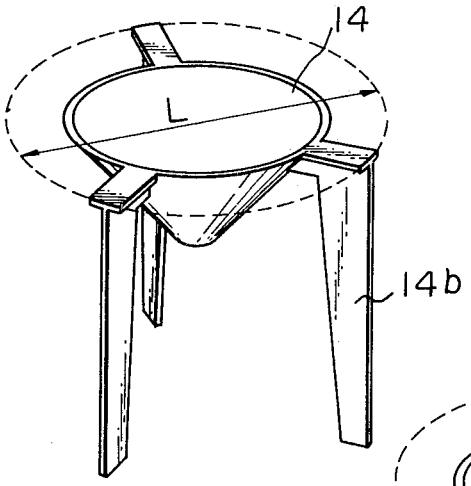
FIGS. 12 and 13 are perspective views showing other modification of the flow deflector.

FIG. 12 illustrates a modification of the embodiment of the first aspect of the present invention shown in FIG. 3. In this modification, legs 14, the confronting distance L of which is made in agreement with the inner diameter of the vessel 1, are utilized as the positioning periphery, and these legs 14*b* are molded integrally with the deflector 14. In this modification, the deflector 14 as a whole can be constructed by integral molding and construction can remarkably be facilitated. Moreover, the weight of the deflector can be reduced. Furthermore, if a synthetic resin is used as the material of the deflector, construction can be further facilitated and the weight-reducing effect can be further enhanced.

Figure 13:
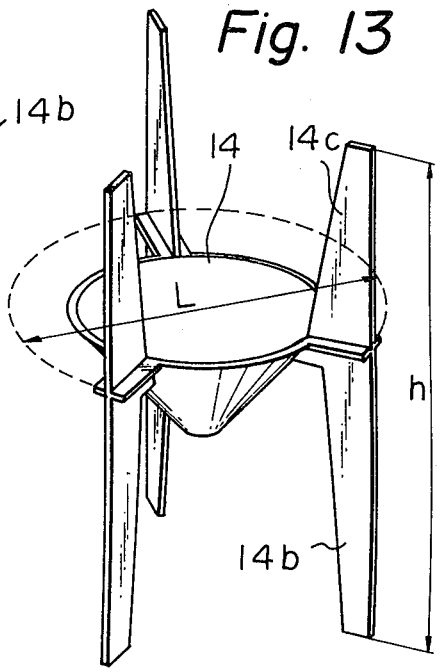

In another modification shown in FIG. 13, the leg 14*b* shown in FIG. 12 has an upper extension 14*c*. The entire length h of the leg 14*b* and extension 14*c* is made slightly shorter than the length H of the adsorbent layer. If this modification is adopted, vertical movement of the flow deflector 14 by vibrations or the like can be prevented. Of course, the flow deflector as shown in FIG. 12 or 13 can be applied to the second aspect of the present invention if the check valve 16 is arranged in the central portion of the deflector.

As will be apparent from the foregoing description, according to the first aspect of the present invention, the flow of the fuel vapor in the adsorbent layer is changed to disperse the fuel vapor in the adsorbent layer, and even if a check valve is not disposed on the flow deflector, the region where desorption is hardly effected can be minimized and there can be attained an excellent effect of utilizing the adsorbent layer much more effectively than in the conventional apparatus.

According to the second aspect of the present invention, since a check valve is disposed on the back face of the bottom of the deflector and this check valve is communicated with the purge chamber exposed to the open air, the check valve can be opened by utilizing the pressure difference produced in the adsorbent layer more assuredly than in the conventional apparatus in which the check valve is directly communicated with the open air without passage through the purge chamber. Therefore, there is no need to unreasonably increase the flow passage resistance of the air hole of the purge chamber so as to open the check valve as in the conventional apparatus. Therefore, one can eliminate the various bad influences due to this.

Furthermore, since the check valve is disposed on the back face of the bottom of the flow deflector and is embedded in the adsorbent layer, the structure of the exising vessel need not be changed, whether or not such check valve may be disposed on the flow deflector.

We claim:

1. A fuel evaporative emission control apparatus for vehicles which comprises a cylindrical vessel in which an adsorbent for adsorbing a vaporized fuel is filled so that open spaces are formed on both ends of the vessel, a vaporized fuel inlet conduit connected to a fuel tank, said conduit being inserted in a layer of said adsorbent from one end of said vessel, and an air-fuel mixture discharge conduit for discharging an air-fuel mixture desorbed from said adsorbent to the outside of said apparatus, said air-fuel mixture discharge conduit being connected to one of said open spaces at the ends of the vessel with the other open space being used as a purge chamber communicated with the open air, wherein the improvement comprises a flow deflector of hollow conical shape or hollow conical frustrum shape having a diameter gradually increasing toward said vaporized fuel inlet conduit, said deflector being embedded in said adsorbent layer coaxially with said vaporized fuel inlet conduit to confront said vaporized fuel inlet conduit, a vertical angle ($\alpha$) of said flow deflector is adjusted to 60° to 120°, the ratio (S1/S2) of a largest-diameter end portion of said flow deflector to a sectional area (S2) of said adsorbent layer is adjusted to 0.4 to 0.6, the ratio (a/b) of a distance (a) between the largest-diameter end portion of said flow deflector and a top end of said adsorbent layer to a distance (b) between said largest-diameter end portion of said flow deflector and a side end of said adsorbent layer is adjusted to at least 1.5, and said distance (a) is made smaller than the sum (g+b) of said distance (b) and a length (g) of said vaporized fuel inlet conduit in said adsorbent layer in an axial direction.

2. An apparatus according to claim 1, further comprising a first check valve unit in said vaporized fuel inlet conduit for allowing the fuel vapor to flow only in one direction from the fuel tank into said vessel, and a second check valve unit in said air-fuel mixture discharge conduit for allowing the mixture to flow only in one direction from said vessel to the outside of said apparatus.

3. An apparatus according to claim 2, wherein said vaporized fuel inlet conduit located in said adsorbent layer has small holes on its perpheral wall so that the fuel vapor is allowed to flow through said holes.

4. An apparatus according to claim 2, wherein the vertical angle ($\alpha$) of said flow deflector is 90°.

5. An apparatus according to claim 2, wherein said flow deflector comprises a hollow conical or conical frustrum body and means for supporting said body at a predetermined distance from a bottom of said vessel.

6. An apparatus according to claim 5, wherein said supporting means comprises legs which are peripherally spaced from one another.

7. An apparatus according to claim 6, wherein said legs are composed of plates peripherally spaced from one another and integral with said body.

8. An apparatus according to claim 7, wherein said plates have end edges which are located on an imaginary circle having a diameter substantially equal to an inner diameter (D) of said vessel.

9. An apparatus according to claim 8, wherein said plates define therebetween separate spaces divided by the adjacent plates.

10. An apparatus according to claim 7, wherein said plates have extensions projecting upward from said body and have a length (h) slightly shorter than a length (H) of the adsorbent layer.

11. A fuel evaporative emission control apparatus for vehicles, which comprises a cylindrical vessel in which an adsorbent for adsorbing a vaporized fuel is filled so that open spaces are formed on both ends of said vessel, a first vaporized fuel inlet conduit connected to a fuel tank, said first conduit being inserted is a layer of said adsorbent from one end of said vessel, a second vaporized fuel inlet conduit connected to a carburetor, and an air-fuel mixture discharge conduit for discharging an air-fuel mixture desorbed from said adsorbent to the outside of said apparatus, said second vaporized fuel inlet conduit and said air-fuel mixture discharge conduit being connected to one of said open spaces at the ends of said vessel with the other open space being used as a purge chamber communicated with the open air, said fuel evaporative emission control apparatus being characterized in that a flow deflector of a conical shape or conical frustrum shape having a diameter gradually increasing toward said first vaporized fuel inlet conduit is embedded in said adsorbent layer coaxially with said first vaporized fuel inlet conduit to confront said first vaporized fuel inlet conduit, a check valve unit which opens only in the direction extending from said purge chamber to an interior of said flow deflector is arranged in said flow deflector, a vertical angle ($\alpha$) of said flow deflector is adjusted to 60° to 120°, the ratio (S1/S2) of a sectional area (S1) of a largest-diameter end portion of said flow deflector to a sectional area (S2) of said adsorbent layer is adjusted to 0.4 to 0.6, the ratio (a/b) of a distance (a) between the largest-diameter end portion of said flow deflector and a top end of said adsorbent layer to a distance (b) between said largest-diameter end portion of said flow deflector and a side end of said adsorbent layer is adjusted to at least 1.5, and said distance (a) is made smaller than the sum (g+b) of said distance (b) and a length (g) of said first vaporized fuel inlet conduit in said adsorbent layer in the axial direction.

12. An apparatus according to claim 11, wherein said check valve unit comprises a hollow valve body which has an air hole therein and which is connected to a bottom of said flow deflector, and a check valve which is always biased into a closed position, said air hole being connected to said purge chamber, so that, when said check valve is opened, the air in said purge chamber is allowed to flow through the bottom of said flow deflector into the latter.

13. An apparatus according to claim 12, wherein said flow deflector comprises a hollow conical or conical frustrum body and means for supporting said body at a predetermined distance from the bottom of said vessel.

14. An apparatus according to claim 13, wherein said supporting means comprises legs which are peripherally spaced from one another.

15. An apparatus according to claim 14, wherein said legs are composed of plates peripherally spaced from one another and connected to said hollow body of said deflector and to said hollow valve body of said check valve unit.

16. An apparatus according to claim 15, wherein said plates have end edges which are located on an imaginary circle having a diameter substantially equal to an inner diameter (D) of said vessel.

17. An apparatus according to claim 16, wherein said plates define therebetween separate spaces divided by the adjacent plates.

18. An apparatus according to claim 15, wherein said plates have extensions projecting upward from said body of said deflector and have a length (h) slightly shorter than a length (H) of said adsorbent layer.

* * * * *